US011799205B1

(12) United States Patent
Byers

(10) Patent No.: US 11,799,205 B1
(45) Date of Patent: Oct. 24, 2023

(54) SPIRAL ANTENNA ASSEMBLY WITH INTEGRATED FEED NETWORK STRUCTURE AND METHOD OF MANUFACTURE

(71) Applicant: Honeywell Federal Manufacturing & Technologies, LLC, Kansas City, MO (US)

(72) Inventor: Kyle J. Byers, Leawood, KS (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 17/834,594

(22) Filed: Jun. 7, 2022

(51) Int. Cl.

| | |
|---|---|
| ***H01Q 9/27*** | (2006.01) |
| ***H01Q 21/00*** | (2006.01) |
| ***H01Q 9/06*** | (2006.01) |
| ***H01Q 15/14*** | (2006.01) |

(52) U.S. Cl.
CPC ..... *H01Q 9/27* (2013.01); *H01Q 9/065* (2013.01); *H01Q 15/141* (2013.01); *H01Q 21/0087* (2013.01)

(58) Field of Classification Search
CPC ..... H01Q 9/27; H01Q 9/065; H01Q 21/0087; H01Q 1/36; H01Q 15/141
See application file for complete search history.

(56) References Cited

U.S. PATENT DOCUMENTS 5,313,216 A * 5/1994 Wang ..... H01Q 1/38 343/895
7,889,151 B1 * 2/2011 Brock ..... H01Q 9/27 343/895
8,390,529 B1 * 3/2013 Paulsen ..... H01Q 11/105 343/895
8,847,846 B1 * 9/2014 Diaz ..... H01Q 9/27 343/895
9,065,176 B2 * 6/2015 Wang ..... H01Q 11/105
(Continued)

FOREIGN PATENT DOCUMENTS

CN 105870605 A 8/2016
CN 111490347 A 8/2020
(Continued)

OTHER PUBLICATIONS

L3Harris Technologies, Inc .; ¾" K-Band Spiral Antenna; L3Harris Fast. Forward.; P/N 53409, Nov. 18, 2014; pp. 1-2.

*Primary Examiner* — Vibol Tan
(74) *Attorney, Agent, or Firm* — Erise IP, P.A.

(57) ABSTRACT

A spiral antenna assembly with an integrated feed network and method of manufacturing the same are disclosed. The spiral antenna assembly may comprise a supporting structure integrally formed with a feed network structure, thereby presenting a monolithic structure. A spiral antenna element may be disposed on a bottom surface or a top surface of the supporting structure. The feed network structure may comprise the feed network and project from a center of the top surface of the supporting structure. The feed network may comprise a microstrip balun architecture. The spiral antenna assembly may be formed by additively manufacturing the supporting structure and the feed network structure. A laser direct structuring process may write and activate the spiral antenna element on the supporting structure and the feed network on the feed network structure.

21 Claims, 5 Drawing Sheets

(56) References Cited

U.S. PATENT DOCUMENTS

| | | | | |
|---|---|---|---|---|
| 9,105,972 | B2 * | 8/2015 | Webb | H01Q 1/007 |
| 9,899,746 | B2 | 2/2018 | Grandfield et al. | |
| 9,917,356 | B2 * | 3/2018 | Jeon | H01Q 1/36 |
| 10,096,892 | B2 * | 10/2018 | Lavin | H01Q 21/06 |
| 10,381,719 | B2 * | 8/2019 | Rahman | H01Q 9/27 |
| 10,386,456 | B1 * | 8/2019 | Zai | G01S 5/14 |
| 10,581,173 | B1 * | 3/2020 | Grady | H01Q 1/273 |

FOREIGN PATENT DOCUMENTS

| | | | |
|---|---|---|---|
| WO | 9725755 | A1 | 7/1997 |
| WO | 2009055667 | A1 | 4/2009 |

* cited by examiner

SPIRAL ANTENNA ASSEMBLY WITH INTEGRATED FEED NETWORK STRUCTURE AND METHOD OF MANUFACTURE

STATEMENT OF GOVERNMENTAL SUPPORT

This invention was made with government support under DE-NA0002839 awarded by the United States Department of Energy/National Nuclear Security Administration. The government has certain rights in the invention.

BACKGROUND

1. Field

Embodiments of the invention relate to antennas. More specifically, embodiments of the invention relate to spiral antennas assemblies with integrated feed network structures and methods of making the same.

2. Related Art

Spiral antennas are often used for wideband radio frequency and direction finding applications. When manufacturing and assembling spiral antennas, it is often difficult to connect a feed network with an antenna element of the spiral antenna. Typically, the antenna element is formed on a printed circuit board, and the feed network is manufactured separately on a distinct structure and subsequently connected to the antenna element. Further, spiral antennas are often cavity-backed, with the feed network fed through the cavity, increasing the overall size of the spiral antenna assembly.

What is needed are improved spiral antennas assemblies with integrated feed network structures to improve the manufacturing efficiency thereof. Further, what is needed are improved spiral antennas assemblies with integrated feed network structures that maintain a wideband performance.

SUMMARY

Embodiments of the invention solve the above-mentioned problems by providing a spiral antenna assembly with an integrated feed network structure and methods of making the same. The spiral antenna assembly may comprise a supporting structure with an antenna element (such as a spiral antenna element) and an integrated feed network structure comprising a feed network, such that the supporting structure is integral with the feed network structure. The supporting structure may comprise a top surface, a bottom surface, and a spiral antenna element on one of the top surface or the bottom surface. The feed network structure may comprise the feed network in the form of a balun and may extend from a center of the top surface of the supporting structure. In some aspects, the feed network structure projects from the supporting structure. In other aspects, the feed network structure projects from the supporting structure at an angle of 45 degrees to 135 degrees from the supporting structure. In yet other aspects, the feed network structure projects normal, or substantially normal, from the supporting structure.

In embodiments where the spiral antenna element is located on the bottom surface of the supporting structure, the supporting structure may comprise vias to electrically connect the feed network to the spiral antenna element.

In some aspects, the techniques described herein relate to a spiral antenna assembly, including: a supporting structure, including: an antenna element on a top surface of the supporting structure, the antenna element including a first arm and a second arm; and a feed network structure projecting from the supporting structure, including: a first side including a first transmission line configured to be electrically connected to the first arm; a second side opposite the first side, the second side including a second transmission line configured to be electrically connected to the second arm; and a dielectric separating the first transmission line from the second transmission line, wherein the supporting structure is integrally formed with the feed network structure to present a monolithic structure thereby providing for the feed network structure to project from the supporting structure a distance based at least in part on a length of the first transmission line.

In some aspects, the supporting structure and the feed network structure may be formed by an additive manufacturing process to present an integrated unit, and the electrical components may be formed thereon by a laser direct structuring process. The integration of the feed network structure with the supporting structure may simplify the manufacturing process of the spiral antenna assembly. In some aspects, the supporting structure is integrally formed with the feed network structure to present a monolithic structure to thereby provide for the feed network structure to project from the supporting structure a distance based at least in part on a length of the first transmission line.

In some aspects, the techniques described herein relate to a spiral antenna assembly, wherein the spiral antenna assembly is formed from an additive manufacturing process.

In some aspects, the techniques described herein relate to a spiral antenna assembly, wherein the spiral antenna assembly includes acrylonitrile butadiene styrene (ABS) doped with an organometallic complex.

In some aspects, the techniques described herein relate to a spiral antenna assembly, wherein the antenna element, the first transmission line, and the second transmission line are laser-activated and metallized via a laser direct structuring process.

In some aspects, the techniques described herein relate to a spiral antenna assembly, wherein the feed network structure further includes a connector on a distal end configured to connect the spiral antenna assembly to a receiver.

In some aspects, the techniques described herein relate to a spiral antenna assembly, wherein the feed network structure is flared at an interface with the supporting structure to increase a strength of a joint between the supporting structure and the feed network structure.

In some aspects, the techniques described herein relate to a spiral antenna assembly, wherein the feed network structure projects substantially normal from the supporting structure.

In some aspects, the techniques described herein relate to a method of manufacture for a spiral antenna assembly, including: printing, using an additive manufacturing device, the spiral antenna assembly, the spiral antenna assembly including: a supporting structure; and a feed network structure projecting from a top surface of the supporting structure, wherein the supporting structure is integrally formed with the feed network structure to present a monolithic structure, thereby providing for the feed network structure to project from the supporting structure; laser-activating the supporting structure to form a spiral antenna element thereon, the spiral antenna element including a first arm and a second arm; laser activating the feed network structure to form a first transmission line on a first side of the feed network structure and a second transmission line on a second side of the feed network structure, wherein the feed network structure projects from the supporting structure a distance based at least in part on a length of the first transmission line; and metallizing the spiral antenna assembly via an electroless plating process to electrically connect the first transmission line to the first arm and the second transmission line to the second arm.

In some aspects, the techniques described herein relate to a method, wherein the method further includes: printing, on a distal end of the feed network structure, a plating-assist element, wherein the plating-assist element is configured to be removed from the spiral antenna assembly after metallizing the spiral antenna assembly via the electroless plating process.

In some aspects, the techniques described herein relate to a method, wherein the spiral antenna element is laser-activated on the top surface of the supporting structure.

In some aspects, the techniques described herein relate to a method, wherein the spiral antenna element is laser-activated on a bottom surface of the supporting structure.

In some aspects, the techniques described herein relate to a method, wherein the supporting structure is printed with at least one via configured to electrically connect the first transmission line and the second transmission line to the spiral antenna element on the bottom surface of the supporting structure.

In some aspects, the techniques described herein relate to a method, wherein the method further includes subsequent to printing the spiral antenna assembly, doping the spiral antenna assembly via a powder coat process.

In some aspects, the techniques described herein relate to a spiral antenna assembly, including: a supporting structure, including: a spiral antenna element on a bottom surface of the supporting structure, the spiral antenna element including a first arm and a second arm; and at least one via extending from a top surface to the bottom surface; and a feed network structure projecting from a center of the top surface of the supporting structure, including: a first side including a conductor; a second side opposite the first side, the second side including a ground plane, wherein the conductor is configured to be electrically connected to the first arm through the at least one via of the supporting structure, and wherein the ground plane is configured to be connected to the second arm through the at least one via of the supporting structure; and a dielectric separating the conductor from the ground plane, wherein the supporting structure is integrally formed with the feed network structure to present a monolithic structure thereby providing for the feed network structure to project from the supporting structure a distance based at least in part on a length of the conductor.

In some aspects, the techniques described herein relate to a spiral antenna assembly, wherein the feed network structure forms an acute angle or an obtuse angle with the supporting structure.

In some aspects, the techniques described herein relate to a spiral antenna assembly, wherein the supporting structure and the feed network structure are fabricated by a fused filament fabrication process, and wherein the spiral antenna element, the conductor, and the ground plane are laser-activated by a laser direct structuring process.

In some aspects, the techniques described herein relate to a spiral antenna assembly, wherein an interface between the supporting structure and the feed network structure is flared to increase a strength of a mechanical joint of the interface.

In some aspects, the techniques described herein relate to a spiral antenna assembly, wherein the at least one via includes a first via and a second via, wherein the conductor is connected to the first arm through the first via, and wherein the ground plane is connected to the second arm through the second via.

In some aspects, the techniques described herein relate to a spiral antenna assembly, wherein at least one of the spiral antenna element, the conductor, or the ground plane are deposited on the spiral antenna assembly by a thin-film deposition process.

In some aspects, the techniques described herein relate to a spiral antenna assembly, further including a removable plating-assist ring for electroless plating of the spiral antenna assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1A:
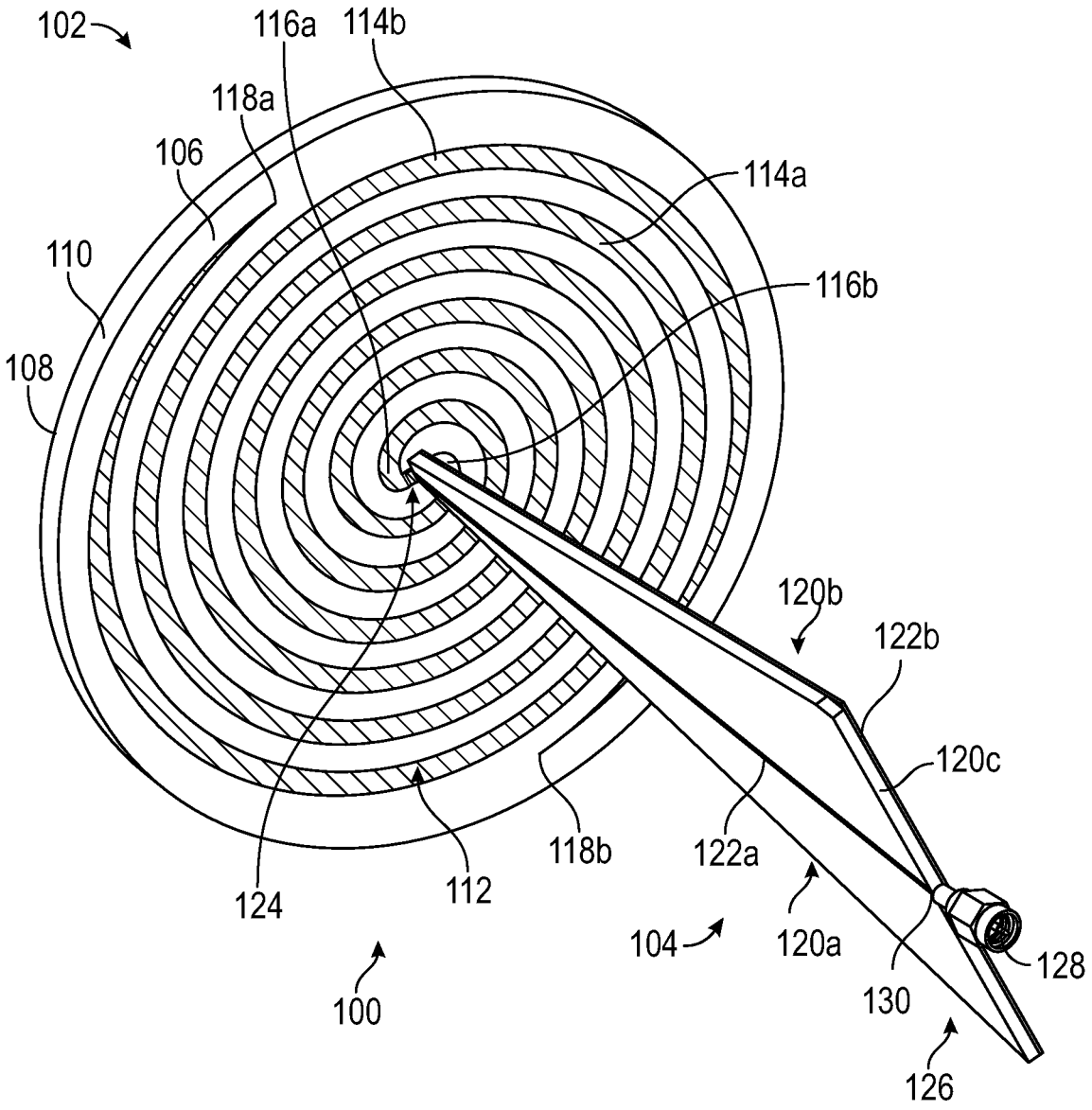
FIG. 1A illustrates a first perspective view of a first spiral antenna assembly embodiment.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Disclosed embodiments generally relate to a spiral antenna assembly comprising a supporting structure with an antenna element and an integrated feed network structure with a feed network. As used herein, the supporting structure includes a laser-activated or thin-film deposited antenna (described further below). Similarly, the feed network structure is a substrate projecting from the supporting structure, where the feed network structure includes the feed network. The feed network structure is configured to receive or have mounted thereon electronic components, such as transmission lines. A feed network (as opposed to a feed network structure) is formed by the feed network structure and the received electronic components.

In embodiments, the supporting structure for the antenna element and the feed network structure for the feed network are formed through the same manufacturing process and instance, such that the feed network structure is integrated with the supporting structure during the instance of manufacturing process. In some aspects, the feed network structure is integrated with the supporting structure such that no mechanical connection or adhesive is used to connect the feed network structure to the supporting structure. Thus, the feed network structure and the supporting structure may present a monolithic structure.

The supporting structure may comprise a spiral antenna element on a top surface or a bottom surface. The feed network structure may extend from near a center of the supporting structure. In some aspects, the feed network structure projects from the supporting structure. In other aspects, the feed network structure projects from the supporting structure at an angle of 45 degrees to 135 degrees from the supporting structure. In yet other aspects, the feed network structure projects normal, or substantially normal, from the supporting structure. The feed network structure may comprise the feed network formed thereon in the form of a balun. In some embodiments, the balun comprises a microstrip architecture. The supporting structure and the feed network structure may be additively manufactured and doped with an organometallic complex. A laser direct structuring process may be performed to activate the conductive traces to form the electrical components on the supporting structure and the feed network structure. By forming the feed network structure and the supporting structure as a monolithic structure via the same instance of manufacturing process, thereby integrating the feed network with the spiral antenna, the overall manufacturing process thereof may be simplified.

Figure 1B:
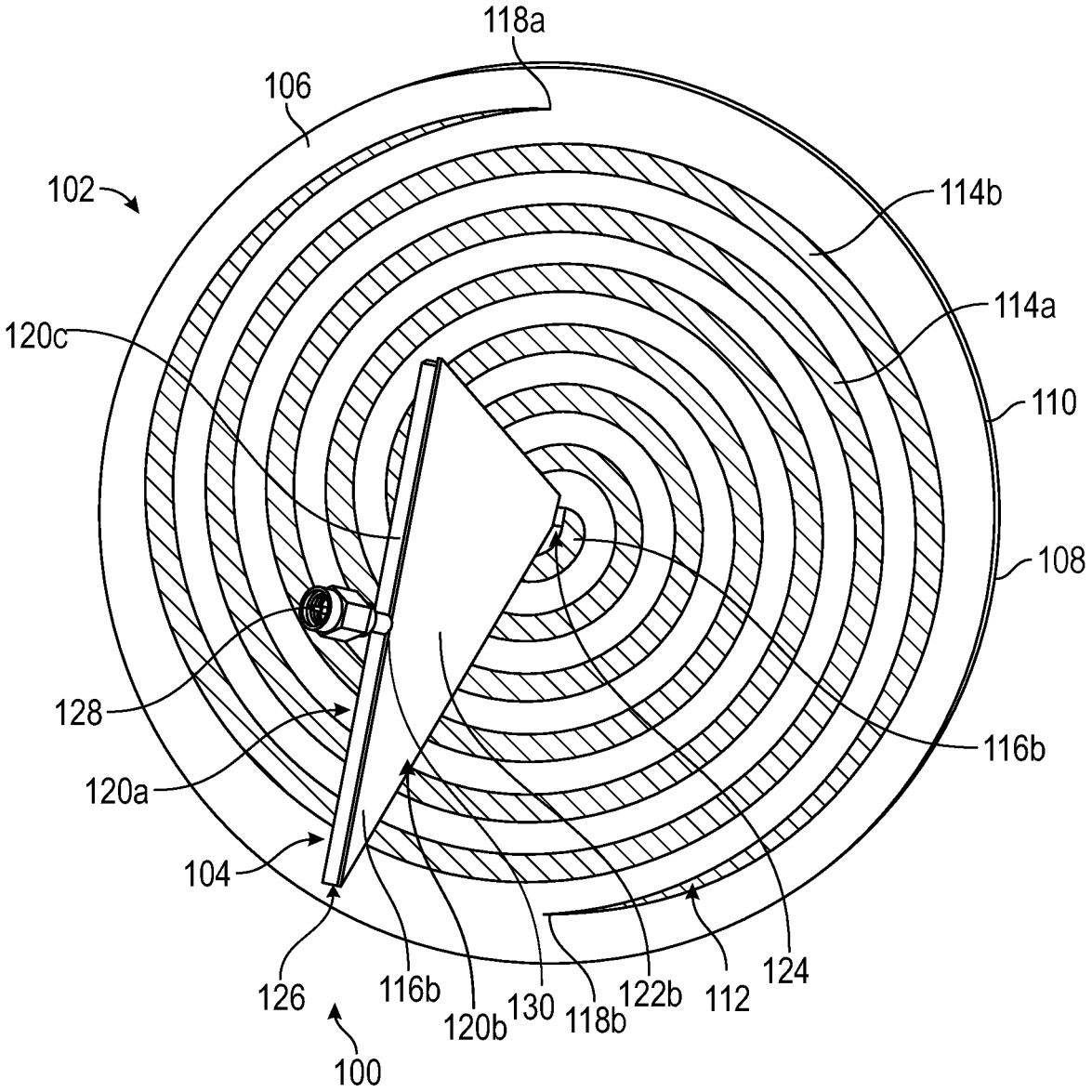
FIG. 1B illustrates a second perspective view of the first spiral antenna assembly embodiment.

FIGS. 1A and 1B illustrate a spiral antenna assembly 100 for some embodiments. Spiral antenna assembly 100 may comprise a supporting structure 102 and a feed network structure 104. Supporting structure 102 may comprise a top surface 106, a bottom surface 108, and a front surface 110. In some embodiments, top surface 106 comprises antenna element 112 thereon. Antenna element 112 may be a spiral antenna element comprising a first arm 114*a* and a second arm 114*b*. First arm 114*a* may have a first origin point 116*a*, and second arm 114*b* may have a second origin point 116*b* emanating from a feed point near a center of top surface 106. Arms 114*a*, 114*b* may interleave outwards from the central feed point and terminate at first terminating point 118*a* and second terminating point 118*b*, respectively. First arm 114*a* may be a conductor arm, and second arm 114*b* may be a ground arm. As illustrated below in FIG. 2B, in some embodiments, antenna element 112 may be disposed on bottom surface 108. Fabricating a spiral antenna assembly 100 with antenna element 112 on top surface 106 or bottom surface 108, as opposed to front surface 110 where antenna elements 112 are typically located, may reduce the complexity of the manufacturing of spiral antenna assembly 100 by providing a substantially flat face on which antenna element 112 is laser-activated or deposited.

Antenna element 112 may take various spiral geometries. For example, antenna element 112 may be a log-periodic spiral antenna, an Archimedean spiral antenna, a square spiral antenna, or any other spiral antenna now known or later developed. While a two-arm antenna is depicted, it should be noted that antenna element 112 may comprise additional arms (e.g., four) without departing from the scope hereof. Spiral antenna assembly 100 may be either right-hand circularly polarized or left-hand circularly polarized. The parameters of antenna element 112, such as the inner and outer radius of arms 114*a*, 114*b*, the width of an arm 114*a*, 114*b*, and the spacing between arms 114*a*, 114*b* may vary in various embodiments based on the desired characteristics of spiral antenna assembly 100. Spiral antenna assembly 100 may be configured for wideband (e.g., having a fractional bandwidth of greater than 20%) or ultra-wideband (e.g., having a fractional bandwidth of greater than 50%) operations. In yet other embodiments, the spiral antenna assembly 100 may include an antenna that is not spiral and is of other antenna types or configurations, such as dipole or microstrip.

In some embodiments, supporting structure 102 may be substantially circular, disc-shaped, square-shaped, or any other geometrical shape. In some embodiments, the geometry of supporting structure 102 matches the geometry of antenna element 112. Thus, for example, a square antenna element 112 may be disposed on a square supporting structure 102. In other embodiments, the geometry of antenna element 112 is distinct from the geometry of supporting structure 102. In some embodiments, supporting structure 102 comprises a diameter or width of about 1 inch to about 1.5 inches. In some embodiments, supporting structure 102 comprises a height or depth of about 0.2 inches to about 0.4 inches as measured from top surface 106 to bottom surface 108. One of skill in the art will appreciate that the dimensions of supporting structure 102 and feed network structure 104 may be suitably adjusted to achieve various operational parameters. For example, the diameter of supporting structure 102 may be increased such that an outer radius of arms 114*a*, 114*b* may be enlarged to increase an upper frequency range of spiral antenna assembly 100. In some embodiments, supporting structure 102 is cavity-backed to limit transmission to a side opposite antenna element 112.

Feed network structure 104 may comprise the feed network for antenna element 112. In some embodiments, the feed network is configured as a balun for connecting antenna element 112 to a receiver or transmitter. Feed network structure 104 may comprise a first side 120*a* opposite a second side 120*b* and a third side 120*c* substantially perpendicular to the first side 120*a* and the second side 120*b*. In some embodiments, third side 120*c* is substantially parallel to top surface 106. A first transmission line 122*a* may be disposed on first side 120*a*, and a second transmission line 122*b* (FIG. 1B) may be disposed on second side 120*b*. First transmission line 122*a* may be electrically connected to first arm 114*a*, and second transmission line 122*b* may be electrically connected to second arm 114*b*. First transmission line 122*a* may be a conductive signal trace connected to the conducting arm. Second transmission line 122*b* may be a ground plane and connected to the ground arm (e.g., second arm 114*b*). Feed network structure 104 may comprise a dielectric separating first transmission line 122*a* from second transmission line 122*b*. Thus, the feed network is formed by the feed network structure 104 (i.e., the dielectric), first transmission line 122*a*, and second transmission line 122*b*. In some embodiments, the feed network is formed as a microstrip balun architecture. In some embodiments, second transmission line 122*b* comprises a width equal to a width of second side 120*b*.

Feed network structure 104 may comprise a proximal end 124 at an interface between feed network structure 104 and supporting structure 102. Feed network structure 104 may project from near a center of top surface 106. In some embodiments, feed network structure 104 projects from an exact center of top surface 106. Feed network structure 104 may project or extend from top surface 106 such that proximal end 124 emanates from top surface 106, and a distal end 126 of feed network structure 104 is vertically displaced from top surface 106. The distance that feed network structure 104 projects (i.e., a height of feed network structure 104) from top surface 106 may be based in part on a length of first transmission line 122*a* which, in turn, may be based on a desired impedance of feed network structure 104.

In some embodiments, feed network structure 104 is substantially triangular or wedge-shaped. Various other geometrical shapes of feed network structure 104 are within the scope hereof, such as a pyramidal or conical shape. In some embodiments, feed network structure 104 is flared near the interface with supporting structure 102 to increase a strength of a mechanical joint formed by the interface, as discussed further below. Feed network structure 104 may extend from top surface 106 at an angle 0 (see FIG. 2A). In some embodiments, feed network structure 104 may be substantially normal to top surface 106. Alternatively, feed network structure 104 may make an acute or obtuse angle with top surface 106. In some embodiments, feed network structure 104 makes an angle θ of about 45 degrees to about 135 degrees relative to top surface 106. In some embodiments, feed network structure 104 comprises a height measured from proximal end 124 to distal end 126 of about 1.5 inches to about 2 inches. In some embodiments, distal end 126 comprises a width of about 0.5 inches to about 1 inch.

Various parameters of the feed network may be varied in various embodiments to adjust the operational parameters of spiral antenna assembly 100. For example, a width of first transmission line 122*a* may be adjusted to achieve a desired input impedance. Further, the width of first transmission line 122*a* may be increased to increase the bandwidth of spiral antenna assembly 100. While the feed network is illustrated as a microstrip transmission line, the feed network may comprise other planar transmission line architectures without departing from the scope hereof. For example, the feed network may be configured as a stripline transmission line having a metallic transmission line sandwiched between a ground plane and a dielectric.

In some embodiments, an RF connector 128 may be disposed on third side 120*c*. RF connector 128 may connect to feed network structure 104 at feed point 130. RF connector 128 may be used to connect the balun to an external receiver, transmitter, or transceiver. In some embodiments, RF connector 128 is an SMA (SubMiniature Version A), an SMB (SubMiniature Version B), an SSMA, or any other RF connector. RF connector 128 may be used to connect the balun/feed network to a coax cable, for example. RF connector 128 may be soldered to third side 120*c*.

Spiral antenna assembly 100 may be formed from various materials. Broadly, spiral antenna assembly 100 may comprise any dielectric or electrically insulating material, such as a thermoplastic. In some embodiments, spiral antenna assembly 100 comprises a polycarbonate, As discussed below, spiral antenna assembly 100 may be printed via an additive manufacturing process and, subsequently, undergo a laser direct structuring process to form the electronic components (i.e., arms 114*a*, 114*b*, transmission lines 122*a*, 122*b*). In some embodiments, spiral antenna assembly 100 is injection molded. In some embodiments, at least one of acrylonitrile butadiene styrene (ABS), polylactic acid (PLA), polyetherimide (PEI), polyether ether ketone (PEEK), or any other printable dielectric material is used as the print material to form spiral antenna assembly 100. In some embodiments, the print material is doped prior to printing with an additive that is laser-activatable by a laser direct structuring process. For example, ABS may be doped with an organic metal complex material that can be activated by the laser. In other embodiments, the print material may be doped after printing of spiral antenna assembly 100, such as via a powder coat process. In still other embodiments, no additive is added to the print material; rather, the conductive traces may be laid down with a thin-film deposition process as discussed below with respect to FIG. 3B.

Figure 2B:
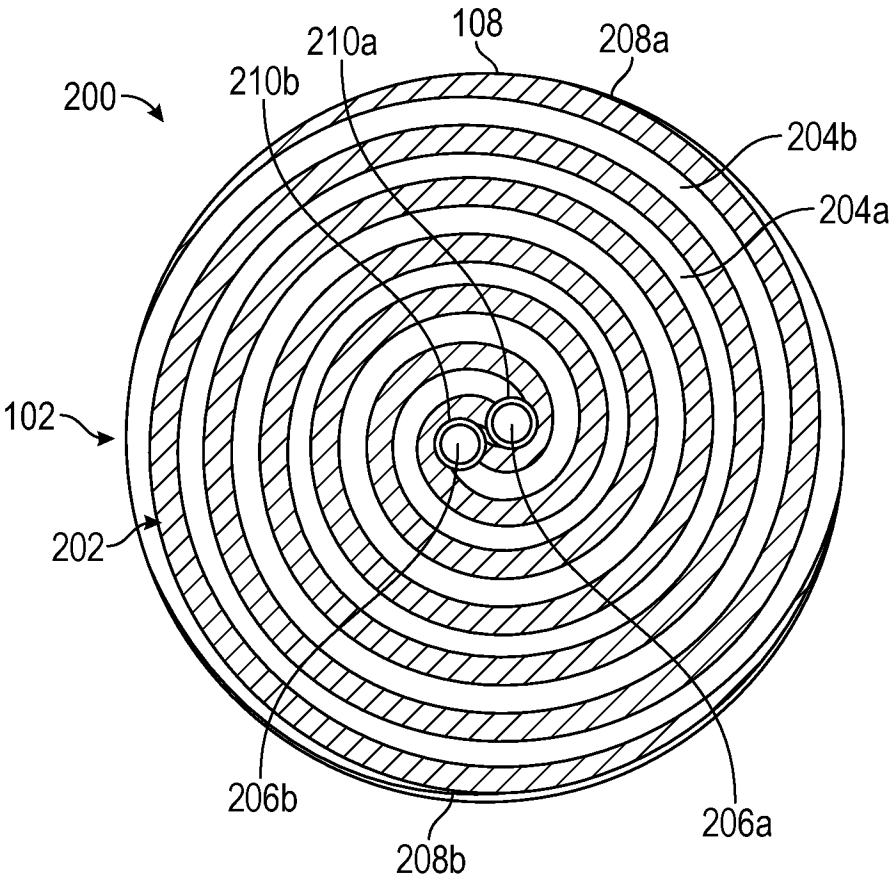
FIG. 2B illustrates a bottom view of a second spiral antenna assembly embodiment.
Figure 2A:
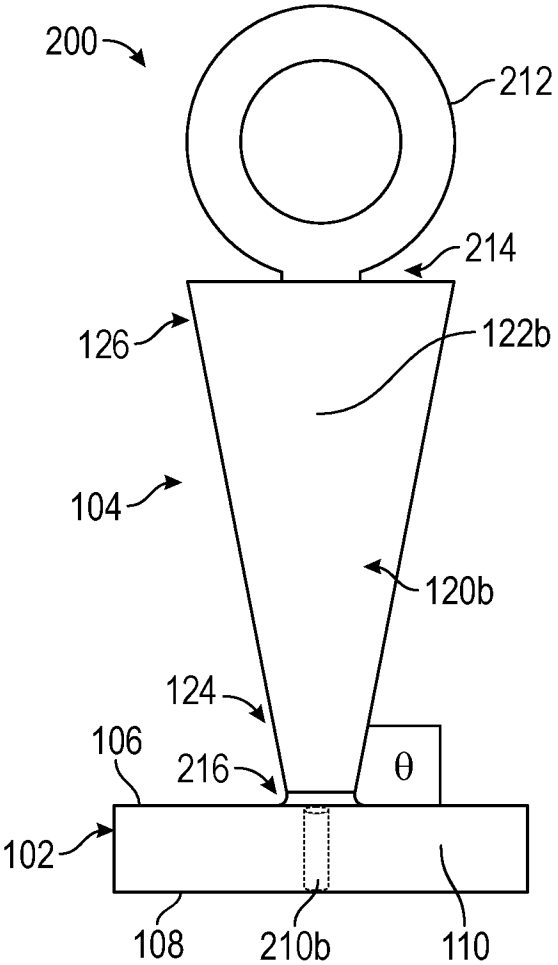
FIG. 2A illustrates a front view of a second spiral antenna assembly embodiment.
Figure 2C:
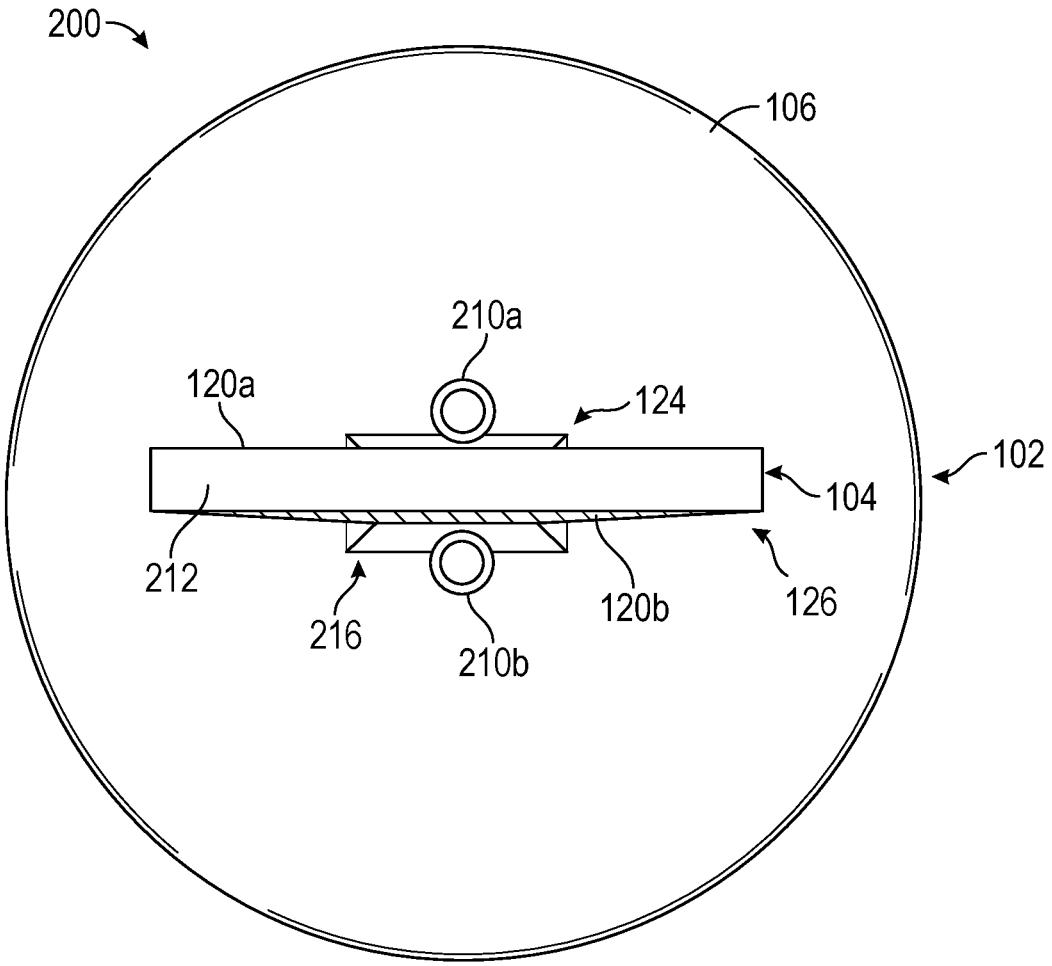
FIG. 2C illustrates a top view of a second spiral antenna assembly embodiment.

FIGS. 2A, 2B, and 2C illustrate a second embodiment of a spiral antenna assembly 200. FIG. 2A illustrates a front view of spiral antenna assembly 200, FIG. 2B illustrates a bottom view of spiral antenna assembly 200, and FIG. 2C illustrates a top view of spiral antenna assembly 200. Spiral antenna assembly 100 may be substantially similar to spiral antenna assembly 200. Where common features or elements are unchanged, they are not discussed separately from their description with respect to FIGS. 1A and 1B.

As depicted in FIG. 2B, spiral antenna assembly 200 may comprise an antenna element 202 disposed on bottom surface 108. Antenna element 202 may be substantially similar to antenna element 112 and comprise a first arm 204*a*, a second arm 204*b*, first origin point 206*a*, second origin point 206*b*, first terminating point 208*a*, and second terminating point 208*b*. In some such embodiments wherein an antenna element is disposed on bottom surface 108, as illustrated in FIG. 2C, top surface 106 comprises no conductive traces thereon. As with spiral antenna assembly 100, feed network structure 104 may extend from near a center of top surface 106 and may be normal thereto. In other embodiments, feed network structure 104 makes an acute or obtuse angle with respect to top surface 106.

To connect first transmission line 122*a* to first arm 204*a* and second transmission line 122*b* to second arm 204*b*, supporting structure 102 may comprise at least one via therethrough. In some embodiments, a first via 210*a* is provided for connecting first transmission line 122*a* to first arm 204*a*, and a second via 210*b* is provided for connecting second transmission line 122*b* to second arm 204*b*. Vias 210*a*, 210*b* may be formed during the printing of spiral antenna assembly 200 or may be formed in a separate process, such as a drilling process. Vias 210*a*, 210*b* may be laser-activated and metallized through the laser direct structuring process to enable an electrical connection between first transmission line 122*a* and first arm 204*a* and between second transmission line 122*b* and second arm 204*b*. Vias 210*a*, 210*b* may be conical near at least one of top surface 106 or bottom surface 108 to enable the laser-activation of vias 210*a*, 210*b*. In some embodiments, vias 210*a*, 210*b* are configured as through-holes.

As previously described, as part of the laser direct structuring process, spiral antenna assembly 100, 200 may undergo electroless plating to metallize the electrical components of spiral antenna assembly 100, 200. Electroless plating is often performed by submerging the components via a rack into an electroless bath. As such, in some embodiments, a plating-assist 212 is formed during fabrication of spiral antenna assembly 100, 200 for use in the electroless plating process. When metallizing spiral antenna assembly 100, 200, plating-assist 212 may be used to hang spiral antenna assembly 100, 200 from the rack for submerging into an electroless copper bath, for example. Plating-assist 212 may be shaped as a ring, as shown, as a hook, or any other enclosed or semi-enclosed geometry such that plating-assist 212 may be suspended from the rack during the electroless plating operation. In some embodiments, plating-assist 212 is omitted from spiral antenna assembly 100, 200, such as when physical vapor deposition is utilized to lay traces on spiral antenna assembly 100, 200.

After the metallization is complete, plating-assist 212 may be removed from spiral antenna assembly 100, 200. In some embodiments, plating-assist 212 is formed with a substantially narrow neck region 214 to provide a substantially weak mechanical connection with feed network structure 104 such that plating-assist 212 is easy to remove from feed network structure 104. For example, neck region 214 may be configured such that a person may twist off plating-assist 212 with their hand after plating is completed.

FIG. 2C depicts a flared region 216 of feed network structure 104 near the interface between supporting structure 102 and feed network structure 104 for some embodiments. In some embodiments, proximal end 124 of feed network structure 104 is flared to increase the strength of the joint formed between feed network structure 104 and supporting structure 102. Flared region may comprise fillets, as shown, or chamfers to widen proximal end to provide additional mechanical support to feed network structure 104. Feed network structure 104 may transition into flared region 216 at about 1 millimeter above top surface 106 in some embodiments. Transmission lines 122*a*, 122*b* may extend through flared region 216 to connect to origin points 206*a*, 206*b* of arms 204*a*, 204*b*.

Figure 3A:
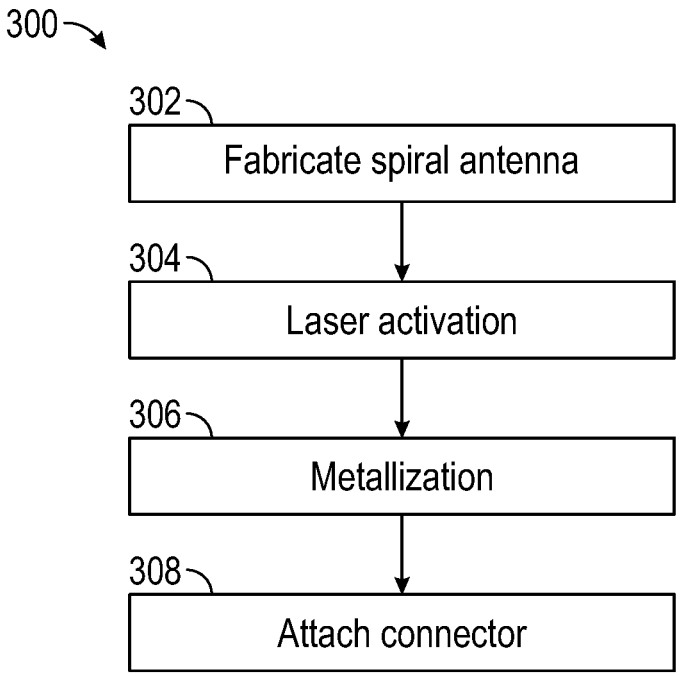
FIG. 3A illustrates a first exemplary method for manufacturing of the spiral antenna assembly for some embodiments.

FIG. 3A illustrates a method 300 for manufacturing spiral antenna assembly 100, 200 for some embodiments.

At step 302, spiral antenna assembly 100, 200 may be fabricated. As previously described, an additive manufacturing device may be utilized to print spiral antenna assembly 100, 200. For example, fused filament fabrication (also known as FUSED DEPOSITION MODELING®) may be used for printing of spiral antenna assembly 100, 200. Broadly, any additive manufacturing process, such as any of binder jetting, directed energy deposition, material extrusion, material jetting, powder bed fusion, sheet lamination, and vat polymerization, may be used to fabricate spiral antenna assembly 100, 200. In other embodiments, spiral antenna assembly 100, 200 may be injection molded. Spiral antenna assembly 100, 200 may be formed from a thermoplastic material, such as ABS, or any other dielectric material. The print material of spiral antenna assembly 100, 200 may be doped with an organometallic complex for activation during the laser direct structuring process. The organometallic complex may be copper- or palladium-based in some embodiments. In some embodiments, spiral antenna assembly 100, 200 is doped with the organometallic complex via a powder coating process. As previously discussed, spiral antenna assembly 100, 200 may be monolithic, thus simplifying the manufacturing process thereof by integrating feed network structure 104 with the supporting structure 102, thereby eliminating the need to assemble the antenna element with the feed network and perform a separate manufacturing process for the feed network. Once fabricated, spiral antenna assembly 100, 200 may comprise supporting structure 102, feed network structure 104, and plating-assist 212.

Next, at step 304, the desired geometry of spiral antenna assembly 100, 200 may be laser-activated. A laser may be used to laser-radiate and ablate the organo-metallic complexes in spiral antenna assembly 100, 200. The laser may write a path corresponding to the desired geometry of spiral antenna assembly 100, 200. For example, the laser may trace a path corresponding to the desired geometry of antenna element 112, 202, first transmission line 122*a*, and second transmission line 122*b*. As the laser contacts the surface of spiral antenna assembly 100, 200, a physical-chemical reaction occurs that forms metallic nuclei that act as a catalyst for copper plating. The laser ablation also creates a roughened surface to which the plating material (e.g., copper) may be anchored during metallization.

At step 306, the laser-activated traces may be plated in an electroless process. In some embodiments, spiral antenna assembly 100, 200 is plated using an electroless copper bath. Other electroless plating processes, such as nickel-phosphorous or nickel immersion gold, may be used without departing from the scope hereof. Spiral antenna assembly 100, 200 may be hung on a rack using plating-assist 212 and submerged into the liquid copper bath whereby the signal traces are metallized. Once the plating operation is complete, plating-assist 212 may be removed from feed network structure 104. Arms 114*a*, 114*b*, 204*a*, 204*b* and transmission lines 122*a*, 122*b* may comprise a thickness of about 5 microns to about 9 microns once metallized.

At step 308, RF connector 128 may be attached to spiral antenna assembly 100, 200. RF connector 128 may be configured to connect the feed network to a receiver or transmitter (not shown). In some embodiments, RF connector 128 may be added to feed network structure 104 near a center of third side 120*c* such that transmission lines 122*a*, 122*b* are electrically connected to RF connector 128.

Figure 3B:
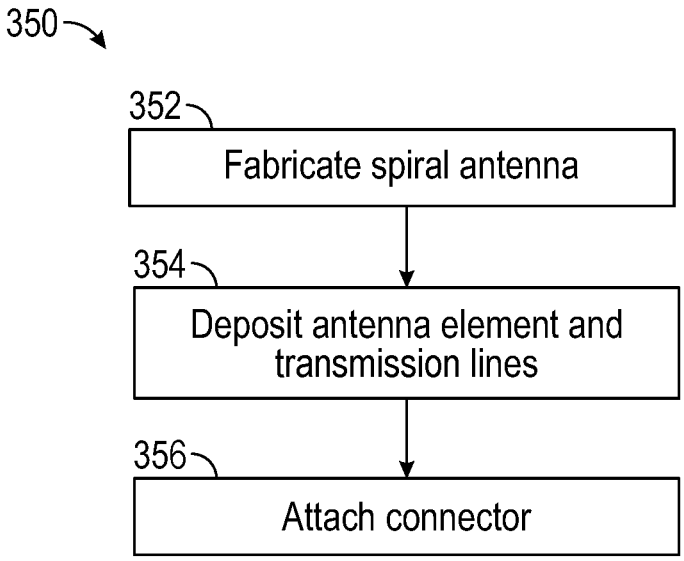
FIG. 3B illustrates a second exemplary method of manufacturing the spiral antenna assembly for some embodiments.

FIG. 3B illustrates a second exemplary method 350 for manufacturing a spiral antenna assembly 100, 200 using a thin-film deposition process to lay down the electrical traces of spiral antenna assembly 100, 200 for some embodiments.

At step 352, spiral antenna assembly 100, 200 may be fabricated. Step 352 may be substantially similar to step 302 described above. Spiral antenna assembly 100, 200 may be fabricated via one of additive manufacturing or injection molding.

At step 354, antenna element 112 and transmission lines 122*a*, 122*b* may be deposited. Various thin-film deposition processes may be utilized to lay down antenna element 112, 202 and transmission lines 122*a*, 122*b*. For example, a physical vapor deposition (PVD) process, such as a sputter deposition process, may be used to lay down the conductive material for arms 114*a*, 114*b*, 204*a*, 204*b* and transmission lines 122*a*, 122*b*. In some embodiments, a chemical vapor deposition process, such as plasma- enhanced chemical vapor deposition (PECVD) may be utilized. In some embodiments, a microplasma sputtering process is used to form the conductive components. In still other embodiments, an additive manufacturing technique, such as aerosol jet printing, may be used to lay down the conductive traces. During the thin-film deposition, an adhesive standoff may be utilized on which spiral antenna assembly 100, 200 may be mounted. In some embodiments, the adhesive standoff is used to mount spiral antenna assembly 100, 200 to an installation surface, such as a vehicle.

Next, at step 356, RF connector 128 may be added to third side 120*c* of feed network structure 104 at feed point 130. Step 356 may be substantially similar to step 308 described above.

Spiral antenna assembly 100, 200 may be used in various wideband radio frequency and direction finding applications. For example, spiral antenna assembly 100, 200 may be used in electronic intelligence (ELINT), electronic warfare, radar warning receiver (RWR), and various other military applications. Spiral antenna assembly 100, 200 may be integrated into the skin of aircraft, for example. In some embodiments, a plurality of spiral antenna assemblies 100, 200 may be connected to form an antenna array. By integrating feed network structure 104 with supporting structure 102 in a single monolithic structure, such that the same manufacturing and laser direct structuring or thin-film deposition process may be performed simultaneously on supporting structure 102 and feed network structure 104, the overall manufacturing efficiency of spiral antenna assembly 100, 200 may be improved while still providing a wideband spiral antenna assembly 100, 200. Furthermore, it is contemplated that the integration of feed network structure 104 with supporting structure 102 may be used for various other antenna types (e.g., dipole) and may be advantageous to simplify the manufacturing process thereof.

Although the invention has been described with reference to the embodiments illustrated in the attached drawing figures, it is noted that equivalents may be employed, and substitutions made herein without departing from the scope of the invention as recited in the claims.

Having thus described various embodiments of the invention, what is claimed as new and desired to be protected by Letters Patent includes the following:

1. A spiral antenna assembly, comprising:
- a supporting structure, comprising:
  - an antenna element on a top surface of the supporting structure, the antenna element comprising a first arm and a second arm; and
- a feed network structure projecting from the supporting structure, comprising:
  - a first side comprising a first transmission line configured to be electrically connected to the first arm;
  - a second side opposite the first side, the second side comprising a second transmission line configured to be electrically connected to the second arm; and
  - a dielectric separating the first transmission line from the second transmission line,
- wherein the supporting structure is integrally formed with the feed network structure to present a monolithic structure thereby providing for the feed network structure to project from the supporting structure a distance based at least in part on a length of the first transmission line,
- wherein the spiral antenna assembly is formed from an additive manufacturing process, and
- wherein the antenna element, the first transmission line, and the second transmission line are laser-activated and metallized via a laser direct structuring process.

2. The spiral antenna assembly of claim 1, wherein the spiral antenna assembly comprises acrylonitrile butadiene styrene (ABS) doped with an organometallic complex.

3. The spiral antenna assembly of claim 1, wherein the feed network structure further comprises a connector on a distal end configured to connect the spiral antenna assembly to a receiver.

4. The spiral antenna assembly of claim 1, wherein the feed network structure is flared at an interface with the supporting structure to increase a strength of a joint between the supporting structure and the feed network structure.

5. The spiral antenna assembly of claim 1, wherein the feed network structure projects substantially normal from the supporting structure.

6. A method of manufacture for a spiral antenna assembly, comprising:
- printing, using an additive manufacturing device, the spiral antenna assembly, the spiral antenna assembly comprising:
  - a supporting structure; and
  - a feed network structure projecting from a top surface of the supporting structure,
  - wherein the supporting structure is integrally formed with the feed network structure to present a monolithic structure, thereby providing for the feed network structure to project from the supporting structure;
- laser-activating the supporting structure to form a spiral antenna element thereon, the spiral antenna element comprising a first arm and a second arm;
- laser activating the feed network structure to form a first transmission line on a first side of the feed network structure and a second transmission line on a second side of the feed network structure,
- wherein the feed network structure projects from the supporting structure a distance based at least in part on a length of the first transmission line; and
- metallizing the spiral antenna assembly via an electroless plating process to electrically connect the first transmission line to the first arm and the second transmission line to the second arm.

7. The method of claim 6, wherein the method further comprises:
- printing, on a distal end of the feed network structure, a plating-assist element, wherein the plating-assist element is configured to be removed from the spiral antenna assembly after metallizing the spiral antenna assembly via the electroless plating process.

8. The method of claim 6, wherein the spiral antenna element is laser-activated on the top surface of the supporting structure.

9. The method of claim 6, wherein the spiral antenna element is laser-activated on a bottom surface of the supporting structure.

10. The method of claim 9, wherein the supporting structure is printed with at least one via configured to electrically connect the first transmission line and the second transmission line to the spiral antenna element on the bottom surface of the supporting structure.

11. The method of claim 6, wherein the method further comprises subsequent to printing the spiral antenna assembly, doping the spiral antenna assembly via a powder coat process.

12. A spiral antenna assembly, comprising:
- a supporting structure, comprising:

a spiral antenna element on a bottom surface of the supporting structure, the spiral antenna element comprising a first arm and a second arm; and at least one via extending from a top surface to the bottom surface; and a feed network structure projecting from a center of the top surface of the supporting structure, comprising:

a first side comprising a conductor;

a second side opposite the first side, the second side comprising a ground plane, wherein the conductor is configured to be electrically connected to the first arm through the at least one via of the supporting structure, and wherein the ground plane is configured to be connected to the second arm through the at least one via of the supporting structure; and a dielectric separating the conductor from the ground plane, wherein the supporting structure is integrally formed with the feed network structure to present a monolithic structure thereby providing for the feed network structure to project from the supporting structure a distance based at least in part on a length of the conductor.

13. The spiral antenna assembly of claim 12, wherein the feed network structure forms an acute angle or an obtuse angle with the supporting structure.

14. The spiral antenna assembly of claim 12, wherein the supporting structure and the feed network structure are fabricated by a fused filament fabrication process, and wherein the spiral antenna element, the conductor, and the ground plane are laser-activated by a laser direct structuring process.

15. The spiral antenna assembly of claim 12, wherein an interface between the supporting structure and the feed network structure is flared to increase a strength of a mechanical joint of the interface.

16. The spiral antenna assembly of claim 12, wherein the at least one via comprises a first via and a second via, wherein the conductor is connected to the first arm through the first via, and wherein the ground plane is connected to the second arm through the second via.

17. The spiral antenna assembly of claim 12, wherein at least one of the spiral antenna element, the conductor, or the ground plane are deposited on the spiral antenna assembly by a thin-film deposition process.

18. The spiral antenna assembly of claim 12, further comprising a removable plating-assist ring for electroless plating of the spiral antenna assembly.

19. The spiral antenna assembly of claim 1, wherein the feed network structure projects from the supporting structure at an angle in a range of 45 degrees to 135 degrees.

20. The spiral antenna assembly of claim 1, further comprising a removable plating-assist ring on a distal end of the feed network structure for electroless plating of the spiral antenna assembly.

21. A spiral antenna assembly, comprising:

a supporting structure, comprising:

an antenna element on a top surface of the supporting structure, the antenna element comprising a first arm and a second arm; and a feed network structure projecting from the supporting structure, comprising:

a first side comprising a first transmission line configured to be electrically connected to the first arm;

a second side opposite the first side, the second side comprising a second transmission line configured to be electrically connected to the second arm; and a dielectric separating the first transmission line from the second transmission line, wherein the supporting structure is integrally formed with the feed network structure to present a monolithic structure thereby providing for the feed network structure to project from the supporting structure a distance based at least in part on a length of the first transmission line, wherein the spiral antenna assembly is formed from an additive manufacturing process, and wherein the spiral antenna assembly comprises acrylonitrile butadiene styrene (ABS) doped with an organometallic complex.

* * * * *